United States Patent [19]

Nixon et al.

[11] Patent Number: 4,943,367

[45] Date of Patent: Jul. 24, 1990

[54] PROCESS FOR THE PRODUCTION OF HIGH PURITY COKE FROM COAL

[75] Inventors: John C. Nixon; John A. Eady; Christopher G. Goodes, all of Victoria, Australia

[73] Assignees: Comalco Aluminum Limited; Alcoa of Australia Limited, both of Melbourne; Alcan Australia Limited, Sydney, all of Australia

[21] Appl. No.: 370,166

[22] Filed: Jun. 21, 1989

Related U.S. Application Data

[63] Continuation of Ser. No. 173,047, Mar. 28, 1988, abandoned, which is a continuation of Ser. No. 906,519, Sep. 12, 1986, abandoned.

[30] Foreign Application Priority Data

Sep. 12, 1985 [AU] Australia ..... PH2396

[51] Int. Cl.[5] ..... C10G 9/14

[52] U.S. Cl. ..... 208/131; 201/24

[58] Field of Search ..... 208/131, 40, 127; 201/2.5, 25, 24

[56] References Cited

U.S. PATENT DOCUMENTS

| | | | |
|---|---|---|---|
| 2,813,824 | 11/1957 | Gorin | 208/53 |
| 2,844,886 | 7/1958 | Nathan | 208/400 X |
| 2,933,522 | 4/1960 | Nathan | 208/400 X |
| 3,960,701 | 6/1976 | Schroeder | 208/400 X |
| 4,013,543 | 3/1977 | Greene | 208/400 |
| 4,111,794 | 9/1978 | Pietzka et al. | 208/131 |
| 4,137,150 | 1/1979 | Pietzka et al. | 208/131 X |
| 4,235,700 | 11/1980 | Metrailer | 208/54 |
| 4,259,178 | 3/1981 | Wynne, Jr. et al. | 208/131 |
| 4,271,006 | 6/1981 | Diekakian | 208/40 |
| 4,333,816 | 6/1982 | Kölling et al. | 208/131 X |

FOREIGN PATENT DOCUMENTS

| | | |
|---|---|---|
| 614448 | 10/1977 | Fed. Rep. of Germany . |
| 1513545 | 6/1978 | United Kingdom . |

*Primary Examiner*—Glenn Caldarola

*Attorney, Agent, or Firm*—Larson and Taylor

[57] ABSTRACT

High purity coke particularly suited to the production of anodes for aluminium smelting is produced by an integrated process that includes flash pryolysis and delayed coking. In the integrated process, flash pyrolysis of carbonaceous materials such as coal, oil shale or tar sand is operated under conditions that maximize the production of tar suitable for coking, and the delayed coking is operated under conditions that maximize the coke yield, and intermediate products may be recycled to enhance overall efficiency.

4 Claims, 1 Drawing Sheet

FPDC Coke Flowsheet

FIG. 1. FPDC Coke Flowsheet
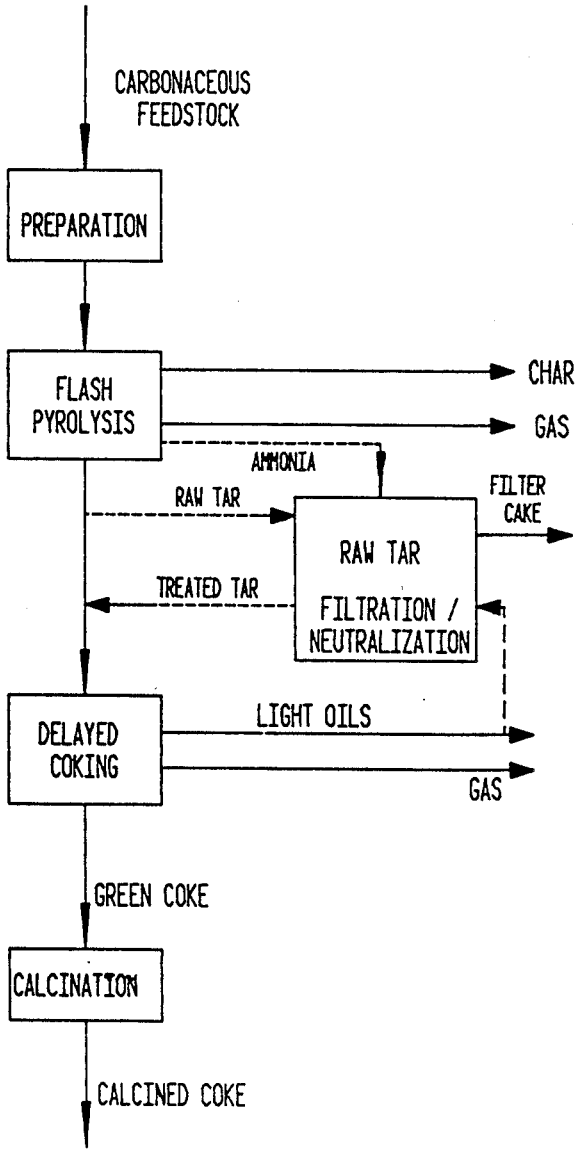

PROCESS FOR THE PRODUCTION OF HIGH PURITY COKE FROM COAL

This application is a continuation of application Ser. No. 07/173,047 filed Mar. 28, 1988, which is a continuation of application Ser. No. 06/906,519 filed Sept. 12, 1986.

FIELD OF THE INVENTION

This invention relates to a new type of high purity coke and a process for making the same. The new type of coke has many applications, such as a blast or electric furnace reductant, but is especially suited to the production of anodes for aluminium smelting. In this application it has significant advantages over conventional materials presently used.

CURRENT STATUS OF TECHNOLOGY

Aluminium is produced commercially by electrolysis of alumina dissolved in molten cryolite, using carbon electrodes. Carbon dioxide is released at the anode as a result of the oxygen liberated on the decomposition of alumina. That is, the liberated oxygen reacts with and consumes the carbon anode. In theory, 0.33 kg of carbon is consumed per kilogram of aluminium produced, while in practice carbon consumptions closer to 0.45 kg are experienced. The carbon consumption in excess of theoretical is a result of various side reactions known to occur in the cell, such as dusting and airburn. Anodes used in the electrolytic production of aluminium are normally fabricated from petroleum coke and coal tar binder pitch. Petroleum coke is a by-product of the petroleum industry while binder pitch is derived from high temperature coke oven tars.

Specific coke properties desired for anode manufacture include low electrical resistivity, low reactivity, high density, low porosity, high resistance to thermal shock and most importantly, high purity. It is also desirable that the coke and pitch form a strong, coherent bond during anode manufacture. The fact that petroleum coke is a by-product of the petroleum industry introduces several distinct disadvantages in these respects. The petroleum cokes currently used in the fabrication of anodes vary markedly in nature, particularly in terms of porosity, and often contain significant levels of impurities. The major impurities include S, Si, V, Ti, Fe and Ni. Whilst S is troublesome due to environmental concerns, the heavy metals, and particularly vanadium, cause both a reduction in the current efficiency of the electrolytic cell and adversely affect the quality of the metal produced. When high purity metal is required, in electrical applications, therefore, expensive refining steps may be necessary.

A further disadvantage of petroleum coke is that its production is mainly confined to the United States. Transportation costs to other countries can become significant.

Clearly, it would be advantageous to find alternative sources of anode materials which retain the desirable properties of petroleum coke, but avoid the specific disadvantages, viz., high impurity and variable porosity levels. An added incentive in finding an alternative carbon source is the resulting independence of the aluminium industry relative to the unrelated petroleum industry. In this manner the consistency and supply of high quality coke to the aluminium industry could be ensured.

Many other workers have also recognized the desirability and in some cases necessity, of developing alternatives to petroleum coke. For example, anodes have been produced from low ash coal and used in aluminium smelters. The properties of these anodes were, however, inferior and high carbon consumptions resulted. More recent attempts to produce anodes from the briquetting of low ash coal have also proven to be unsuccessful.

Further attempts to an alternative to petroleum coke have included coke shale oil, from solvent refined coal and from pitch derive high temperature coke oven tar. While these processes h been found to produce coke with some desirable properties example low impurity levels, they are generally uneconomical. A relatively small quantity of coke is derived from co oven tar in Japan, although this coke is limited in su and, consequently, demands a premium price. No commercial plants exist for the production of coke from either shale or solvent refined coal.

GENERAL DESCRIPTION OF THE INVENTION

A technique for producing high quality coke according to the invention, hereinafter named "FPDC (Flash Pyrolysis - Delayed Coking) Coke", largely based upon a novel combination or integration of processes, namely flash pyrolysis and delayed coking. Individually, both processes are intended for markedly different purposes Therefore, in addition to combining the processes in a novel manner, it is also necessary to modify the conventional operating philosophies of the two processes in order to produce the desired FPDC coke.

"Flash pyrolysis" is a process whereby a carbonaceous feedstock is rapidly heated in a fluidized bed, in the absence of oxygen, to produce a relatively high tar yield. In its conventional intended application, tars produced by this process (FPT) are used as an intermediary in the production of liquid fuels. This requires substantial hydrogenation, in contrast to the de-hydrogenation required for the production of FPDC coke.

"Delayed coking" is the process used commercially to produce petroleum coke from refining residues. In conventional refinery practices with petroleum feedstocks, the objective is to maximize the recovery of liquid components at the expense of coke yield. Petroleum coke is, therefore, a by-product of the refinery. Feedstocks to the coker are also quite variable, resulting in regular shifts in coke quality. Delayed coking as applied to FPT according to this invention differs significantly from the process normally applied to refinery residues. In this application maximizing the coke yield, consistency and quality are the primary concerns. The coker must, therefore, be operated in a significantly different manner to conventional refinery residues.

In addition to product consistency and low levels of trace metals, we have found that FPDC coke has other and unexpected advantages over petroleum coke. These include low porosity, high density, low resistivity, low reactivity and good compatibility with binder pitch. There is also the potential to produce low sulphur coke, provided a coal feedstock containing suitably low levels of sulphur is used. For example, Australian coals fall clearly into this category. FPDC coke is not, therefore, merely a substitute for petroleum coke but offers advantages for anode manufacturers.

BRIEF DESCRIPTION OF THE DRAWINGS

A flowsheet for the new coke making process is shown in FIG. 1.

Broadly, a starting feedstock of coal is subjected to flash pyrolysis to produce tar, gas and residual char. The tar produced by flash pyrolysis is subsequently filtered to remove unseparated char, and then used as a feedstock to the delayed coking unit. A high yield of FPDC coke is obtained in comparison with petroleum coke feedstocks and, therefore, the delayed coking must be operated in a significantly different manner to that of the prior art. As an optional step, the FPT may be neutralized prior to coking, using process derived ammonia gas. This neutralization stage can most likely be avoided, however, if suitable materials of construction are used in the plant.

DETAILED DESCRIPTION

A preferred embodiment of the process will now be described in greater detail with reference to the flowsheet shown in FIG. 1.

A major advantage of the new process is that it is applicable to a wide range of carbonaceous starting materials. For the best yields of tar (and therefore FPDC coke), the carbon precursor should contain a significant proportion of volatile material and have a low caking tendency. A large number of coals, both black and brown, satisfy these criteria and are relatively inexpensive in comparison to premium coking coals. In addition to coals, other materials such as oil shales and tar sands could also be used. Although the nature of the feedstock will not affect the quality of the coke, it will determine the properties of the other process streams.

The as-mined feedstock must be physically treated prior to pyrolysis. In the case of black coal, the following preferred procedure may be adopted;

(1) Beneficiation, to reduce the ash content to around 20% or less.

(2) Air drying of the washed coal to $<10\%$ moisture.

(3) Crushing of the coal to $<0.18$ mm particle size.

It should be noted that reduction through beneficiation is a widely used procedure in the coal industry, although with a different intention in mind. Although this step is not essential in the process, and in no way affects the properties of the FPDC coke, ash reduction is desirable to ensure the quality of the char product. For materials other than coal, oil shale for example, it may not be feasible nor desirable to reduce the ash level to any extent. The char produced would be, consequently, of lower fuel value.

The following flash pyrolysis stage is central to the new process and involves the rapid heating of the feedstock to high temperatures in an inert atmosphere. A number of different flash pyrolysis technologies have been developed, with the aim of producing an intermediate coal liquid suitable for upgrading to a crude oil equivalent, while also producing a combustible char. A flash pyrolysis process developed by the CSIRO has been found suitable for the process of this invention, because of its high yield of tar and suitability of the latter for delayed coking. Other flash pyrolysis technologies could also be applied to the process of the invention, although lower yields of coke may result.

In the CSIRO process crushed and dried coal is injected into a fluidized bed reactor at temperatures between 400° and 800° C. and the coal is rapidly heated at rates approaching $10^{5}$° C. $S^{-1}$. The is conducted in an inert atmosphere, at atmospheric or near atmospheric pressure. The coal decomposes into tar vapour, char and gas components. The vapours are rapidly removed from the reaction zone and cooled to condense the tar fraction. The combination of a high heating rate and rapid quenching of the tar vapours results in high liquid yields being obtained.

A critical factor affecting the yield and properties of the tar is the pyrolysis temperature selected. Within a range of 400° and 800° C., an optimum yield was obtained at 600° C.

Some comments on the characteristics of the products of flash pyrolysis are given below:

Flash pyrolysis tar is a complex combination of the atoms C, H, N, O and S, varying in ratios according to the production conditions and nature of feedstocks. In order to produce the highest yield on coking, it is desirable for the tar to have a low H/C ratio and, most importantly, a high Conradson Carbon Coking value. This value is an indicator used widely in the petroleum industry to predict the coke yield of potential coker feedstocks. Flash pyrolysis tar has a Conradson Carbon coking value around twice that of conventional petroleum feedstocks. Consequently, different delayed coking procedures are required. It should be noted that the properties of FPT vary significantly from those of high temperature coke oven tar, specifically in terms of aromaticity and oxygen content. Because of the particular characteristics of high temperature oven tar, light components must first be distilled prior to delayed coking. Such a stage is not required with FPT, however.

The char produced from the flash pyrolysis of coal is in a pulverized form, is dry and has a high surface area. These properties make it very suitable as a pulverized fuel for power station use. Char produced from coal is, therefore, a very useful by-product of the FPDC coke process. Char produced from higher ash materials, such as oil shale, may not be suitable for power generation, however, because the ash present in the starting material reports almost totally in the char.

Pyrolysis gas consists of a range of hydrocarbon gases, in addition to CO, $CO_2$ and hydrogen. Analyses indicate that this gas will have a medium energy value and hence will be suitable as an in-process fuel, however it also has specific characteristics which permit its ready conversion to hydrogen gas. This is very convenient as hydrogen may be used for the upgrading of coal liquids produced from the delayed coking of flash pyrolysis tar.

During flash pyrolysis, complete separation of char from tar vapours, prior to condensation, is not always achieved. For this reason a tar filtration stage may be required in the invention. The nature of the solids material carried over into the tar during flash pyrolysis indicates that a number of commercial filtration processes will be suitable and, most importantly, that filtration can be achieved efficiently at a moderately low cost. Ease of filtration of FPT has been successfully demonstrated, with almost complete removal of solid material being achieved. The addition of in-process oils derived from the delayed coking unit has been shown to have a beneficial effect on filtration rates and critical filtration parameters. Preferred pressure filtration methods include rotary drum filters and candle filters.

As an additional step, it may also be necessary to neutralize the acidic components of the FPT prior to coking to avoid corrosion and contamination of the coke with iron. The neutralization step could be achieved by passing process derived ammonia gas through molten FPT, although other alternatives are available. Neutralization, combined with tar filtration, ensures that the FPDC coke is at least of equal purity compared with petroleum coke, and far superior in respect of certain elements. It should be recognized, however, that the neutralization and filtration stages may not be necessary in a commercial plant. This will depend on the char/tar vapour separation efficiency achieved and the selection of corrosion resistant materials for plant construction.

Flash pyrolysis tar plus in-process oils from the neutralization and filtration units sent to the delayed coking module for coke production. In commercial practice, the operation of the delayed coker varied according to the characteristics of the coker feedstock, although the objective is always to maximize the yield of the liquid products. As petroleum coke is considered only as a by-product of the petroleum refinery no attention is paid to either quality or consistency. Coke yield is a complex function of coking conditions and the nature of the feedstock. One advantage of coking flash pyrolysis tar is that a very high coke yield can be obtained in comparison with petroleum feedstocks, although to achieve this the coker must be operated under a different set of conditions. Specifically, a higher feedrate is required, this being critical in order to achieve the desired rate of volatile evolution and hence to produce FPDC coke with acceptable density and porosity characteristics. Because the properties of the FPT feed to the delayed coker can be carefully maintained and controlled, FPDC coke of consistent quality may be produced. Other important coking parameters include % recycle, ratio of desired coker oils, drum pressure and temperature, each of which must be tailored to suit the specific properties of the feedstock and the product distribution required.

In the process of the invention, flash pyrolysis tar and in-process oils are sent to the bottom of a fractionator where material with a boiling point lower than the desired end point is flashed off. The desired end point for FPT is around 250° C. The remainder is combined with recycle heavy oils derived from the coker (at around 15–20% recycle) and pumped to a preheater and then on to the coking drum. The coke drum is filled over an extended period, usually 24 hours, after which time the top of the coke drum is taken off and the coke removed, usually by hydraulic cutting. The appearance and bulk form of the new coke are identical to petroleum coke and well suited for conventional coke handling procedures and current anode fabrication techniques. This is extremely desirable as FPDC coke could be directly substituted for petroleum coke in a commercial smelting process plant, without the need for expensive equipment modifications or replacement.

In addition to coke, both and oils and gas are also produced during delayed coking of FPT. The coker oils may be divided into two fractions, namely the 'light oils' which have a boiling point less than 300° C. and heavy oils which boil above 300° C. The heavy oils are recycled to the coker in order to improve coke yield. Another desirable feature of the process is that the light oils could be a suitable feedstock to an oil refinery for further upgrading to liquid fuel status. The oils would first require some upgrading to increase the hydrogen content and reduce the aromaticity of the liquid, however. This upgrading can be performed by hydrogenation, according to conventional and proven technologies. The gases produced both from flash pyrolysis and delayed coking of FPT are suitable for conversion to pure hydrogen, using established oil refinery technology. Alternatively, the gases are of medium to high energy content and could be used to generate power via combustion.

Flash pyrolysis tar coke removed from the coker typically contains a volatile content ranging between 4 and 15%. As with petroleum coke, this level can be controlled accurately by varying the coking temperature. In order to be suitable for electrode production the volatile content must be reduced to less than 0.5%. This reduction is achieved by calcination. Accompanying the reduction in volatile (and hydrogen) content of the coke is a general shrinkage in the coke matrix and a corresponding rise in bulk density.

Calcination of the FPDC coke is performed in the exact manner of the calcination of petroleum coke, typically in a rotating drum calcination furnace at temperatures ranging between 1100° and 1300° C. Below 1100° insufficient volatiles removal occurs while calcination above 1300° can lead to excessive decrepitation and hence high coke porosity.

Properties of the calcine FPDC coke are excellent in comparison with petroleum coke, exhibiting extremely low impurity levels and excellent consistency. The low impurity levels will allow a premium grade high purity metal to be made. FPDC coke also displays a number of unexpected properties which are highly desirable. These include:

(i) High density and low porosity, particularly in the 1–30 μm range. This results in a low requirement for binder pitch and, combined with low impurity levels, will render the coke relatively un-reactive towards airburn and $CO_2$ attack.

(ii) Low resistivity, which will result in anodes with significantly lower resistance, and hence energy consumption.

(iii) High coherence and strength.

(iv) Low sulphur levels, when a suitable starting feedstock is used. This is highly desirable for environmental reasons.

In addition to anodes for the aluminum industry, many of these particular characteristics of FPDC coke are desirable in a blast or electric furnace reductant.

Calcined FPDC coke can be fabricated into anodes suitable for aluminium production using a similar procedure to petroleum coke. In the case of pre-baked anodes, this involves crushing and screening the material to the desired granulometry or particle size range, the addition of binder pitch at levels ranging between 10 and 20%, followed by mixing at temperatures between 120° and 200° C. Binder pitch is generally derived from by-product tars taken from high temperature carbonization oven. The new coke and pitch mixture is then formed into blocks and baked at temperatures approaching 1200° C. Fabrication of Soderberg type anodes differs from pre-baked anodes in that the coke and pitch mixture is baked in-situ in the electrolytic cell. Consequently, a lower baking temperature is achieved.

The coke of the invention differs from petroleum coke in terms both of the optimum coke granulometry to give the best anode properties, and the level of binder pitch required. In particular, FPDC coke requires less fines than petroleum coke which could reduce crushing costs. In addition the optimum pitch level is typically 1–2% less than for petroleum cokes. This reduction would result in very significant cost savings, as pitch is a relatively expensive component of the anode. A further advantage in anode manufacture is that, unlike petroleum coke, FPDC coke is a mainstream product not subject to fluctuations in coke properties and overall quality. As result, with FPDC coke it is not necessary to change anode fabrication conditions in response to changes in coke properties, such as occurs with petroleum coke, Consequently, anodes can always be fabricated from FPDC coke at the optimum conditions.

After fabrication of anodes from FPDC coke, they must then be baked under similar, but not necessarily identical, conditions to those employed with conventional petroleum coke anodes.

The properties of the carbon anodes derived from the new material are similar to, and in some cases superior, to those prepared from petroleum coke. Superior properties include high purity, low resistivity and high strength. A further advantage has also be noted. The microstructure of FPDC coke is very similar to that of binder coke, allowing excellent bonding between the two to occur. This similarity will also reduce their differential reactivity, resulting in a lower propensity for dusting.

Production of the new FPDC coke is demonstrated in the following examples.

FLASH PYROLYSIS

A sample of high volatile steaming coal, washed to around 20% ash, was crushed and screened to less than 180 microns. The composition of the coal was as follows:

| Analysis (Air Dried Basis) | wt % |
|---|---|
| Moisture | 3.0 |
| Ash | 19.8 |
| Volatile Matter | 42.5 |
| Fixed Carbon | 34.7 |
| Specific Energy (MJ/kg) | 25.8 |
| Carbon | 60.6 |
| Hydrogen | 5.2 |
| Nitrogen | 0.9 |
| Sulphur | 0.5 |
| Oxygen | 10.0 |

The coal was fed to a fluidized bed flash pyrolysis reactor, at a rate of 20 kilograms per hour. The pyrolysis temperature was maintained at 600° C. by means of natural gas injection. The following product yields were obtained, expressed on a dry, ash-free bases:

| | |
|---|---|
| Tar | 35% |
| Gas | 16% |
| Char | 49% |

These products had the following properties:

Char

| Air Dried Basis | wt % |
|---|---|
| Moisture | 2.2 |
| Ash | 36.0 |
| Volatile Matter | 13.9 |
| Fixed Carbon | 47.5 |
| Specific Energy (MJ/kg) | 20.0 |

Gas

| | vol. % |
|---|---|
| Methane | 40.5 |
| Ethane | 9.5 |
| Ethylene | 11.5 |
| N-Butane | trace |
| Hydrogen | 28.0 |
| Remainder | 10.5 |

Tar

| Dry Ash Free Basis | |
|---|---|
| C | 81.4 |
| H | 7.6 |
| N | 1.1 |
| S, O } by difference | 9.9 |
| atomic H/C | 1.12 |

Tar Filtration

Tar from the previous example, containing 1.2% ash, was filtered to less than 0.05% ash in a pressure filtration unit. Optimum filtration conditions were found to occur in the following ranges:

| | |
|---|---|
| Temperature: | 140–160° C. |
| Pressure: | 350–450 KPa |
| % Recycle Oil*: | 40–50% |

*Refers to 'light oils' derived from the delayed coking of fpt.

Delayed Coking

A laboratory coker having an internal diameter of 15 cm was used. Filtered FPT was introduced into the coke drum at a rate of 250 gm/hr. The delayed coking unit was operated at a temperature of 480° C. and a pressure of 400 KPa, with 15% heavy oil recycle. Following 38 hours of operation, coke was removed from the drum and a mass balance calculated. The following yields were obtained:

| Input | mass (kg) | Output | mass (kg) | Yield, % of Fresh Tar |
|---|---|---|---|---|
| Filtered FPT | 9.48 | FPT Coke | 4.71 | 49.7 |
| Heavy Oil | 1.67 | Heavy Oil (BP > 300° C.) | 2.47 | 8.4 |
| | | Light Oil (BP < 300° C.) | 0.99 | 10.4 |
| | | Gas (by | 2.98 | 31.4 |
| | 11.15 | difference) | 11.15 | 100.0 |

It is likely that a coke yield of 60% will be achieved when heavy oils are recycled to extinction.

The properties of the gas and light oil are shown below. purity, low resistivity, high strength, high density and low porosity. Good bonding was observed between the binder and FPDC coke. Similar advantages to those obtained in pre-bake anodes may also be expected in Soderberg Type anodes.

It will clearly be understood that the invention in its general aspects is not limited to the specific details referred to hereinabove.

| Gas Analyses (Vol %) | FPT Coker Gas | Commercial Pct. Feedstock Coker Gas |
|---|---|---|
| Carbon Monoxide | 5.2 | 5.8 |
| Carbon Dioxide | 4.8 | 1.4 |
| Methane | 47.8 | 48.0 |
| Ethane | 14.1 | 11.5 |
| Ethylene | 3.1 | 3.0 |
| Propane | 4.2 | 9.3 |
| Propylene | 3.5 | 4.7 |
| N-Butane | 0.4 | 3.2 |

| Oil Analyses | FPT Light Coker Oil | Crude Oil (Gippsland, Vic) |
|---|---|---|
| Approx. Boiling Range °C. | 66–453 | 40–590+ |
| Naptha (<180° C.) vol % | 8 | 34 |
| Kerosene (180–230° C.) vol % | 21 | 9 |
| Diesel (230–350° C.) vol % | 49 | 25 |
| Diesel + (350° C. - EP) vol % | 22 | 32 |
| Specific Gravity (20° C. g/cc) | 0.98 | 0.80 |
| % Aromatic C by $C^{13}$ NMR | 59 | — |
| g OH/l | 56.0 | — |
| wt % C | 81.6 | 86 |
| wt % H | 9.6 | 14 |
| wt % N | 0.4 | 0.01 |
| wt % S | 0.2 | 0.1 |
| wt % O | 8.2 | — |
| atomic H/C | 1.4 | 1.9 |

The FPDC coke produced in the laboratory delayed coking facility was found to contain 10% volatile matter, typical of un-calcined petroleum coke. The coke was subsequently calcined at 1300° C. for one hour, and was found to have the following properties.

| Physical Properties | FPDC Coke | Typical Range Pet. Coke |
|---|---|---|
| Real Density ($gcm^{-3}$) | 1.99 | 2.00–2.08 |
| Resistivity (Ω mm) | 0.89 | 1.0–1.25 |
| Bulk Density (1.40–2.36 mm fraction) | 0.88 | 0.73–0.85 |
| Porosity (1–30 μm, $mm^3/g$) | 25 | 60–90 |

| Chemical Properties (wt %) | FPDC Coke | Typical Range Pet. Coke |
|---|---|---|
| Ash | 0.31 | 0.15–.50 |
| Nickel | .0012 | .015–.05 |
| Vanadium | <.002 | .035–.05 |
| Sodium | <.0045 | .015–.05 |
| Calcium | <.0023 | .005–.01 |
| Silicon | .026 | .01–.05 |
| Iron | 0.097 | .01–.05 |
| Sulphur | .46 | 1.5–3.5 |
| Volatiles | 0.1 | <.5 |
| Water | 0.3 | .2–.5 |

The high levels of iron and silicon observed in the FPDC coke most likely arise from corrosion of laboratory equipment. This problem appears to be exacerbated by the high surface to volume ratio encountered, as corrosion also occurred to a lesser extent when using petroleum feedstocks in the same equipment. Although a neutralization stage could be included in a full-scale plant, it is likely that the problem may be avoided by the use of more appropriate materials of construction.

A feature of the FPDC coke is the low levels of trace metals, such as Ni, V, Na and Ca which will enable very pure alumininum metal to be produced. The current efficiency of an aluminium cell using anodes fabricated from FPDC coke will also be improved, because of the high coke purity. The sulphur content of the coke is also low, although this is related to the sulphur content of the coal feedstock. As demonstrated in the example, FPDC coke displays a number of unexpected benefits in addition to purity. These include high density, low porosity in the 1–30 micron range and low electrolytic resistivity.

ANODE FABRICATION

In order to demonstrate the benefit of FPDC coke for anode manufacture, a number of prebaked laboratory anodes were fabricated and tested. The coke was first crushed and screened to the desired granulometry, mixed with binder pitch and baked at 1150° C. The properties of such anodes are shown in the following, in comparison with anodes fabricated from petroleum coke on a similar scale.

Anode Properties

| Property | FPDC Coke Anode - 500 gm Scale | FPDC Coke Anode - 5 kg Scale | | Typical Range Pet. Coke |
|---|---|---|---|---|
| Binder Pitch Content (wt %) | 16* | 13.6 | 14.4 | 15–17 |
| Green Density (g/cc) | 1.69 | 1.68 | 1.70 | 1.54–1.65 |
| Baked Density (g/cc) | 1.70 | 1.59 | 1.57 | 1.52–1.60 |
| Porosity (%) | 16.7 | 18.9 | 19.2 | 17–25 |
| Resistivity (μΩm) | 42.1 | 56.0 | 51.2 | 50–70 |
| Compressive Strength (MPa) | — | 34.1 | 33.2 | 30–55 |
| Carbon Consumption (% Theoretical) | 110 | 118 | 119 | 110–130 |

* It should be noted that pitch demand for anodes fabricated on the 500 gm scale is artifically high, related to the relatively fine granulometry.

The perceived advantages of FPDC coke in pre-bake anode manufacture were confirmed in the laboratory anodes. These advantages included, in comparison with petroleum coke, low pitch requirement, high

We claim:

1. Process for the production of high purity coke from black coal, which comprises the following steps:
   (a) beneficiating the coal to an ash content not exceeding 20%;
   (b) air drying the product of step (a) to less than 10% moisture;
   (c) crushing the product of step (b) to a particle size less than 0.18 mm;
   (d) subjecting the product of step (c) to a flash pyrolysis in a fluidized bed reactor in which it is rapidly heated in an inert atmosphere to a temperature in the range 400° to 800° C. at atmospheric or near atmospheric pressure, whereby it decomposes into tar vapor, char and gas components;
   (e) rapidly quenching the product of step (d) to condense liquid tar, filtering the liquid tar to remove char therefrom, and neutralizing acidic components of the said liquid tar;
   (f) subjecting the liquid tar product of step (e) to delayed coking to produce coke and coker oils;
   (g) dividing the coker oils from step (f) into light oils boiling below 300° C. and heavy oils boiling above 300° C., and recycling heavy oils to step (f); and
   (h) calcining coke from step (f) to produce a high purity coke of volatile content less than 0.5%.

2. Process according to claim 1, in which the tar produced in step (e) is filtered and acidic components of the said tar are neutralized prior to step (f).

3. Process according to claim 1, in which the neutralization is effected using ammonia produced in the flash pyrolysis step (d).

4. Process according to claim 1, in which light oils from step (g) are recycled to the tar filtration/neutralization step.

* * * * *